US010246896B2

(12) United States Patent
Libby et al.

(10) Patent No.: US 10,246,896 B2
(45) Date of Patent: Apr. 2, 2019

(54) POLES FOR SUPPORTING SATELLITE DISHES

(71) Applicant: WECONNECT LLC, Seymour, WI (US)

(72) Inventors: Brad Libby, Lowell, ME (US); Gary Rumpf, Middletown, CT (US)

(73) Assignee: WECONNECT LLC, Seymour, WI (US)

( * ) Notice: Subject to any disclaimer, the term of this patent is extended or adjusted under 35 U.S.C. 154(b) by 0 days.

(21) Appl. No.: 15/952,390

(22) Filed: Apr. 13, 2018

(65) Prior Publication Data

US 2018/0298629 A1 Oct. 18, 2018

Related U.S. Application Data

(63) Continuation-in-part of application No. 15/486,473, filed on Apr. 13, 2017, now Pat. No. 9,972,883.

(51) Int. Cl.

| | |
|---|---|
| ***E04H 12/00*** | (2006.01) |
| ***E04H 12/34*** | (2006.01) |
| ***H01Q 1/48*** | (2006.01) |
| ***H01Q 1/12*** | (2006.01) |
| *A45F 3/44* | (2006.01) |

(52) U.S. Cl.

CPC ..... *E04H 12/347* (2013.01); *H01Q 1/1242* (2013.01); *H01Q 1/48* (2013.01); *A45F 3/44* (2013.01)

(58) Field of Classification Search

CPC ..... E04H 12/347; H01Q 1/1242; H01Q 1/48; A45F 3/44

See application file for complete search history.

(56) References Cited

U.S. PATENT DOCUMENTS

| | | | |
|---|---|---|---|
| 3,200,554 | A | 8/1965 | Goodman et al. |
| 3,285,554 | A | 11/1966 | Voelkerding |
| RE26,779 | E | 2/1970 | Weichenrieder et al. |
| 3,731,517 | A | 5/1973 | Johnson |
| 4,407,089 | A | 10/1983 | Miller |
| 5,022,618 | A | 6/1991 | Barret et al. |

(Continued)

OTHER PUBLICATIONS

Product # POLEHEX238-2-8FT-3PK Exede Hex Pole, 2.375" OD w/2&wuot; OD End, 96" Long (14 GA) (3PK). Perfect10. (https://www.perfect-10.tv/WebStore/ProductDetail.aspx?ID=11029). Accessed Apr. 12, 2018.

*Primary Examiner* — Anita M King

(74) *Attorney, Agent, or Firm* — Andrus Intellectual Property Law, LLP

(57) ABSTRACT

A device configured to support an object above the ground. The device includes a first end and an opposite second end, an axis being defined between the first end and the second end. A body surrounds the axis and extends from the first end to the second end. A mount section of the body is closer to the first end than to the second end. The mount section has a first cross-section and is configured to be coupled to the object. The first cross-section has a circular shape. A main section of the body is located between the mount section and the second end, which has a main cross-section having a hexagonal shape. An indentation in the body is closer to the second end than to the first end. The device is configured to be installed in the ground such that the indentation is below the ground.

16 Claims, 5 Drawing Sheets

(56) References Cited

U.S. PATENT DOCUMENTS

| | | | | |
|---|---|---|---|---|
| 5,349,780 | A | 9/1994 | Dyke | |
| 5,848,502 | A | 12/1998 | Schaefer | |
| 6,234,444 | B1 | 5/2001 | Haddad | |
| 6,922,942 | B2 | 8/2005 | Stefanutti | |
| 7,412,866 | B2 * | 8/2008 | Jahani | B21C 25/08 301/124.1 |
| 7,905,053 | B2 * | 3/2011 | Lisciotti | A01G 17/14 47/47 |
| 7,980,520 | B2 * | 7/2011 | Taylor | A45F 3/44 248/156 |
| 9,671,061 | B2 * | 6/2017 | Meiners | F16M 13/02 |

* cited by examiner

POLES FOR SUPPORTING SATELLITE DISHES

CROSS REFERENCE TO RELATED APPLICATIONS

This application is a continuation-in-part application of U.S. patent application Ser. No. 15/486,473, filed Apr. 13, 2017, which is incorporated herein by reference in its entirety.

FIELD

The present disclosure generally relates to poles for supporting a satellite dish, and more particularly to poles for supporting satellite dishes having better performance, more flexibility, and easier installation.

BACKGROUND

The Background and Summary are provided to introduce a foundation and selection of concepts that are further described below in the Detailed Description. The Background and Summary are not intended to identify key or essential features of the claimed subject matter, nor are they intended to be used as an aid in limiting the scope of the claimed subject matter.

Over the past few decades, new technology and innovations have allowed consumers to send and receive communications over long distances wirelessly, using satellites. Information is sent to and received from satellites orbiting the Earth by means of satellite dishes located at home, commercial, or industrial locations. These modern systems are sometimes referred to as direct-broadcast satellite television (DBSTV) systems, also known as "direct-to-home" (DTH) systems. DTH systems typically require installing an outdoor parabolic antenna, commonly referred to as a satellite dish of "dish", that is directed towards the transmitting satellite orbiting the Earth above. These satellite dishes are typically supported by a pole, which is either anchored into the ground or mounted to the roof or siding of a house. In a typical arrangement, the back or convex side of the parabolic dish is coupled to a mounting clamp that clamps onto this pole, allowing the satellite dish to remain fixed relative to the pole after the dish is in proper alignment to the satellite. A pole for ground assembly is typically 6' or 8' tall.

SUMMARY

One embodiment of the present disclosure generally relates to a device configured to support an object above the ground. The device includes a first end and a second end that is opposite the first end with an axis defined between the first end and the second end. A body surrounds the axis and extends from the first end to the second end. A mount section of the body is closer to the first end than to the second end. The mount section has a first cross-section and is configured to be coupled to the object. The first cross-section has a circular shape. A main section of the body is located between the mount section and the second end, where the main section has a main cross-section, and where the main cross-section has a hexagonal shape. An indentation in the body is closer to the second end than to the first end. The device is configured to be installed in the ground such that the indentation is below the ground.

Another embodiment generally relates to a device configured to support an object above the ground. The device includes a first end and a second end that is opposite the first end with an axis defined between the first end and the second end. A body surrounds the axis and extends from the first end to the second end. A mount section of the body is closer to the first end than to the second end. The mount section has a first cross-section and is configured to be coupled to the object. A main section of the body is located between the mount section and the second end, where the main section has a main cross-section. An indentation in the body is closer to the second end than to the first end. A sight line along the main section is closer to the second end than to the first end, where the sight line signifies a distance from the second end to the sight line. The first cross-section is different than the main cross-section and the device is configured to be installed in the ground such that the indentation is below the ground. The indentation is configured to prevent heaving when the device is installed in the ground to a depth in which the sight line is at or below the ground.

Another embodiment generally relates to a device configured to support an object above the ground. The device includes a first end and a second end that is opposite the first end with an axis defined between the first end and the second end. A body surrounds the axis and extends from the first end to the second end. A mount section of the body is closer to the first end than to the second end. The mount section has a first cross-section and is configured to be coupled to the object. A secondary pipe has a first end and a second end that is opposite the first end with a secondary axis defined between the first end and the second end of the secondary pipe. The secondary pipe is nested within the body such that the axis of the body and the secondary axis of the secondary pipe are coaxial and such that the secondary pipe prevents deflection of the body. An indentation in the body is closer to the second end than to the first end. The device is configured to be installed in the ground such that the indentation is below the ground.

Another embodiment generally relates to a device configured to support an object above the ground. The device includes a first end and a second end that is opposite the first end with an axis defined between the first end and the second end. A body surrounds the axis and extends from the first end to the second end. A first mount section of the body is closer to the first end than to the second end, where the first mount section has a first cross-section and is configured to be coupled to the object. A second mount section of the body is closer to the second end than to the first end, where the second mount section has a second cross-section and is configured to be coupled to the object. A main section of the body is located between the first mount section and the second mount section, where the main section has a main cross-section, where the first cross-section is different than the main cross-section, and where the main cross-section and the second cross-section are different. A first indentation in the body is closer to the first end than to the second end. A second indentation in the body is closer to the second end than to the first end. A secondary pipe has a first end and a second end that is opposite the first end with a secondary axis defined between the first end and the second end of the secondary pipe. The secondary pipe is nested within the body such that the axis of the body and the secondary axis of the secondary pipe are coaxial and such that the secondary pipe prevents deflection of the body. The device is configured to be installed in the ground such that one of the first indentation or the second indentation is below the ground.

Another embodiment generally relates to a device configured to support an object above the ground. The device includes a first end and a second end that is opposite the first end with an axis defined between the first end and the second end. A body surrounds the axis and extends from the first end to the second end. A mount section of the body is closer to the first end than to the second end. The mount section has a first cross-section having a first area and is configured to be coupled to the object. A main section of the body is located between the mount section and the second end. The main section has a main cross-section having a main area, where the main area is different than the first area. An indentation in the body is closer to the second end than to the first end. The first cross-section is different than the main cross-section and the device is configured to be installed in the ground such that the indentation is below the ground.

Various other features, objects and advantages of the disclosure will be made apparent from the following description taken together with the drawings.

BRIEF DESCRIPTION OF THE DRAWINGS

The drawings illustrate the best mode presently contemplated of carrying out the disclosure. The same numbers are used throughout the drawings to reference like features and like components. In the drawings.

DETAILED DISCLOSURE

Figure 1:
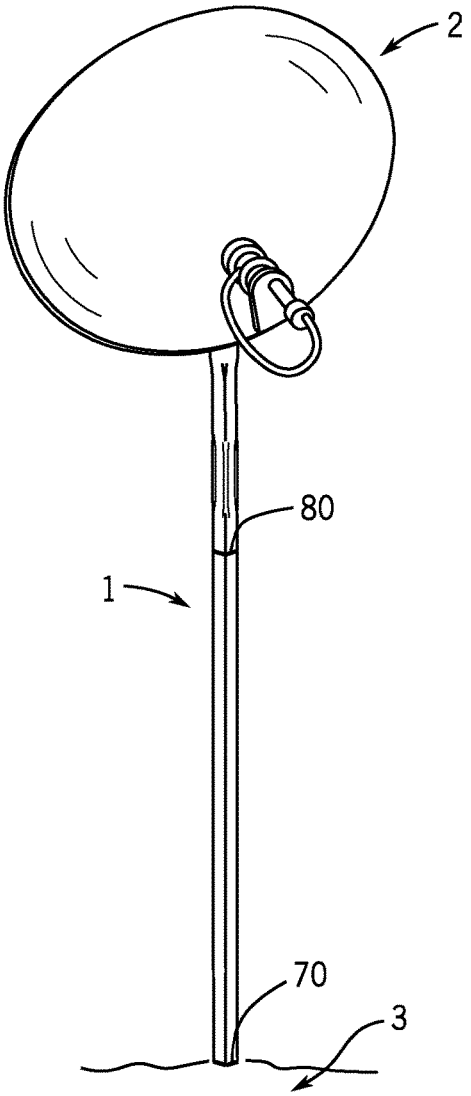
FIG. 1 is an exemplary view of a device in accordance with the present disclosure, supporting a satellite dish.

This written description uses examples to disclose embodiments of the disclosed invention, including the best mode, and also to enable any person skilled in the art to practice or make and use the same. The patentable scope of the invention is defined by the claims and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The present disclosure generally relates to devices for supporting objects above the ground, or above another surface or object, in a durable and consistent manner. Throughout this disclosure, specific details are provided relating to a pole for supporting a satellite dish, either above the ground or on a structure, such as a house. However, the present disclosure is not limited to this particular embodiment or application.

The present inventors have identified shortcomings to the existing devices and methods used for supporting satellite dishes known in the art. First, the different manufacturers of satellite dishes, as well as the type of content being provided, often require different sizes of poles to be installed for supporting the corresponding satellite dish device. For example, one satellite content provider may require a dish that has mounting mechanism requiring one diameter of pole, whereas another provider may require a second diameter of pole for installation. Consequently, installation personnel must maintain a sufficient stock of poles of all possible diameters in anticipation of the different requirements for installation.

Additionally, the present inventors have identified issues with maintaining the accuracy of aiming a satellite dish to the satellite over a long term period, which is of the utmost importance for reliability and clarity of the communicated signal. Specifically, round poles are presently used for installing satellite dishes, which leaves the entire dish and pole assembly susceptible to spin. Even if the mounting device is clamped securely to the pole, the entire pole and dish assembly may be rotated by bumping the dish, by a strong wind catching the dish, or simply by children playing around the pole in an innocent and unknowing manner.

Similar shortcomings arise from installing satellite dishes using the poles known in the art in regions of the world where ground freezing occurs. Per specification, the poles are typically to be installed below the frost line to prevent heaving in winter. However, the present inventors have identified that poles often are not, or even cannot, be installed below the frost line. Moreover, using a pole having sufficient length to be installed to a depth below the frost line would necessarily increase the cost of the pole and further require additional stock to be held by installation personnel. Consequently, poles that are installed in the ground in regions that experience freezing are susceptible to heaving. Even in regions where no freezing occurs, it is known in the industry that directional winds can create an upward force on a dish or other object coupled to the pole, causing the pole to be lifted upwardly. This heaving and/or lifting disrupts the alignment of the satellite dish to the satellite, can damage the pole, and can even result in the damage to the pole and satellite dish upon tipping over, which may also damage other objects being impacted by the fall. The present inventors have identified that even a one-eight-inch change in the position of the pole (and consequently, the dish) can be detrimental to its alignment with the satellite, which is prevented by the presently disclosed device.

Furthermore, the applicants have identified that it is difficult for installation personnel to know how deep a pole has been installed in the ground, further exacerbating the issue of heaving. Beyond heaving, the difficulty in knowing how far to install a pole, or how far it has already been installed, risks maintaining sufficient depth to provide the structural integrity required by the pole to support the expensive satellite dish mounted on top. It is also difficult to discern, such as during a later audit, whether the pole was installed to a proper depth.

Through testing and experimentation, the present inventors have developed the presently disclosed device and method for improving upon the pole for supporting a satellite dish. FIG. 1 depicts an exemplary satellite dish 2 that is supported above the ground 3, but which is supported by a pole 1 in accordance with the present disclosure. In some applications, the pole 1 may be installed directly into the ground 3, cemented in place, or clamped to another structure, such as a fence or building. The pole 1 is designed to remain rigidly fixed in the ground 3 after installation such that adjustments to the alignment of the satellite dish 2 to the satellite overhead (not shown) are made by adjusting the satellite dish 2 relative to the pole 1.

Figure 2:
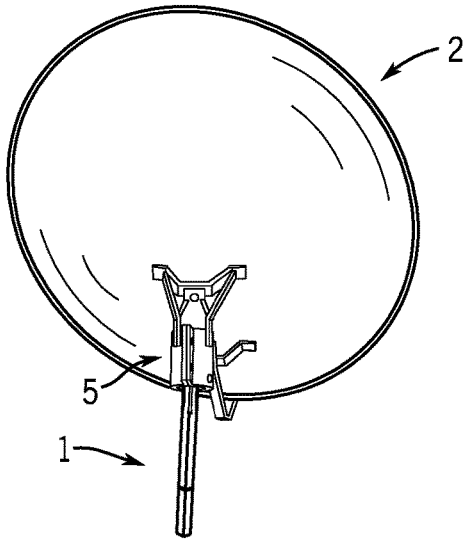
FIG. 2 shows an exemplary mounting device on the back of a satellite dish to couple the satellite dish to a pole.

FIG. 2 shows the back or convex side of a typical satellite dish 2, including the mounting device 5 for coupling the satellite dish 2 to the pole 1. As shown, the pole 1 has a first end 12 that is installed in the ground 3, which is opposite of a second end 14 that is coupled to the pole 1 via the mounting device 5. The present inventors have noted that the mounting device 5 of a satellite dish 2 is commonly configured to be mounted to a round pole.

Figure 3:
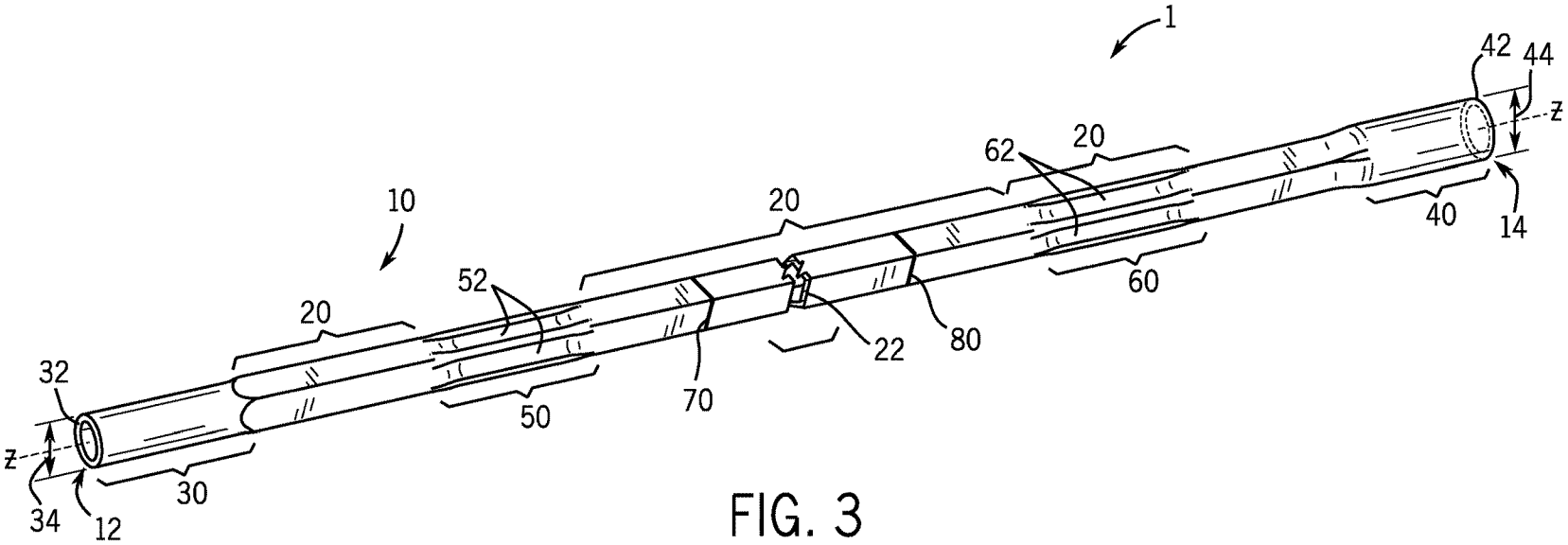
FIG. 3 is an isometric view of one embodiment of a device for supporting a satellite dish in accordance with the present disclosure.

FIG. 3 shows the pole 1 of the present disclosure before being installed in the ground or being mounted to a satellite dish 2. The pole 1 has a first end 12 opposite a second end 14 with an axis z defined between the first end 12 and the second end 14. The pole 1 comprises a body 10 that surrounds the axis z and extends from the first end 12 to the second end 14. The main section 20 of the body 10 has a main cross-section 22 that is preferably hexagonally shaped. The present inventors have designed the main section 20 of the pole 1 to have the hexagonal shape to prevent spin between the pole 1 and the ground 3 as occurs with round poles known in the art. By providing the hexagonal shape of the main section 20, the presently disclosed pole 1 has inherent anti-spin protection and, thus, improved performance over poles known in the art. However, it should be known that the presently disclosed main cross-section 22 may have of other shapes that provide anti-spin protection, including but not limited to triangular, squared, pentagonal, heptagonal shapes.

The pole 1 has a first mount section 30 that is closer to the first end 12 than the second end 14, shown here as extending from the first end 12 along the body 10. The first mount section 30 has a first cross-section 32, which is shown here to be circular, but which would be otherwise shaped. The first mount section 30 likewise has a first diameter 34.

At an end opposite the first mount section 30, certain embodiments of the pole 1 have a second mount section 40 having a second cross-section 42, also shown to be circular. The second mount section 40 has a second diameter 44. The second mount section 40 is shown to be closer to the second end 14 than to the first end 12 and, in the example, begins at the second end 14 and extends along the pole 1 towards the first end 12.

In the embodiment shown in FIG. 3, the first mount section 30 and second mount section 40 are shown to have a circular first cross-section 32 and a second cross-section 42 to accommodate the mounting device 5 of typical satellite dishes 2 despite the main section 20 of the pole 1 having a main cross-section 22. However, the first mount section 30 and/or the second mount 40 can be of any shape configured to engage with the mounting device 5 or mounting devices of interest, including but not limited to hexagonal shapes. It should also be known that the mounting device 5 need not directly contact the pole 1, but may be coupled through an intermediate component.

Moreover, by designing the pole 1 to have a different first diameter 34 and second diameter 44, the same pole 1 can be used for mounting two different sizes of mounting devices 5 for satellite dishes 2. This halves the number of poles 1 to be stocked by installation personnel, who need only flip the pole 1 to select the desired size for installation. However, as will become apparent below, many of the benefits of the embodiment shown also apply to poles 1 having only one mounting size (also referred to as one-sided poles), including the additional strength of the shape, benefits of manufacturability, anti-heave, anti-lift, anti-twist, and sight line guidance for installation, for example.

In the embodiment shown in FIG. 3, the pole 1 further includes a first indentation section 50 and a second indentation section 60. The first indentation section 50 contains a plurality of first indentations 52, wherein the first indentations 52 extend inwardly from the body 10 of the pole 1 towards the axis z. Similarly, the second indentation section 60 has a plurality of second indentations 62 that also extend inwardly from the body 10 of the pole 1 towards the axis z.

Figure 4:
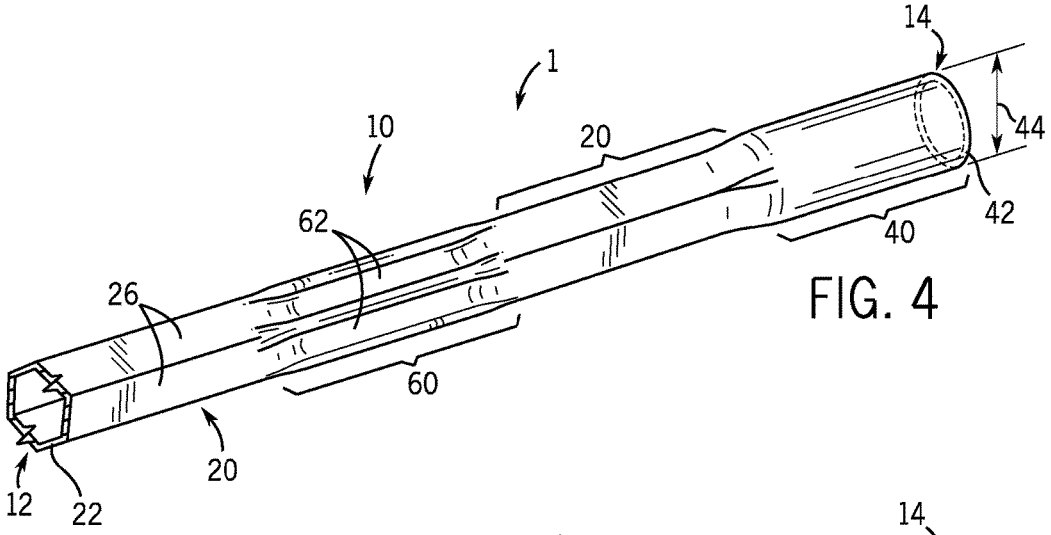
FIGS. 4-6 depicts exemplary mounting ends in accordance with the present disclosure.
Figure 5:
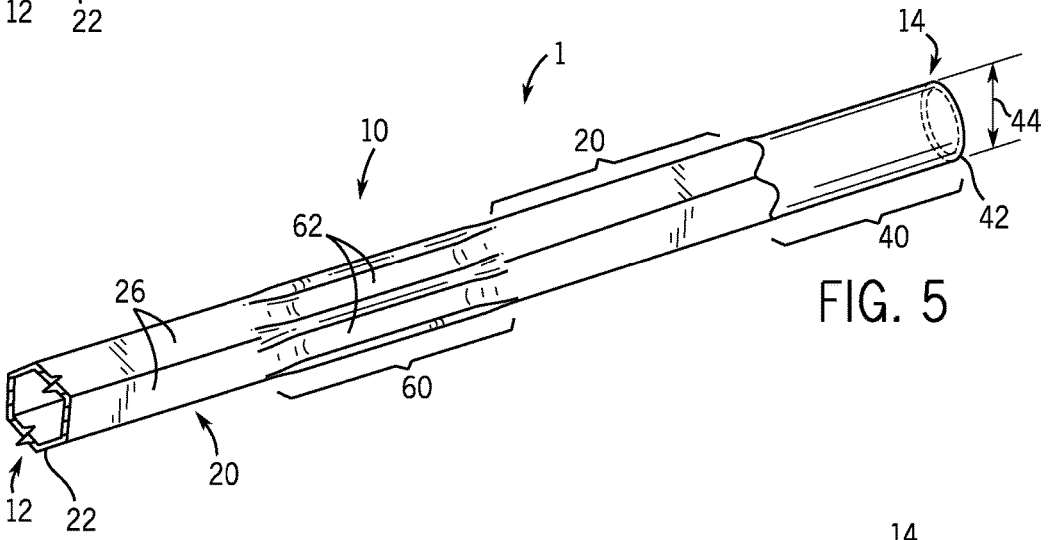
Figure 6:
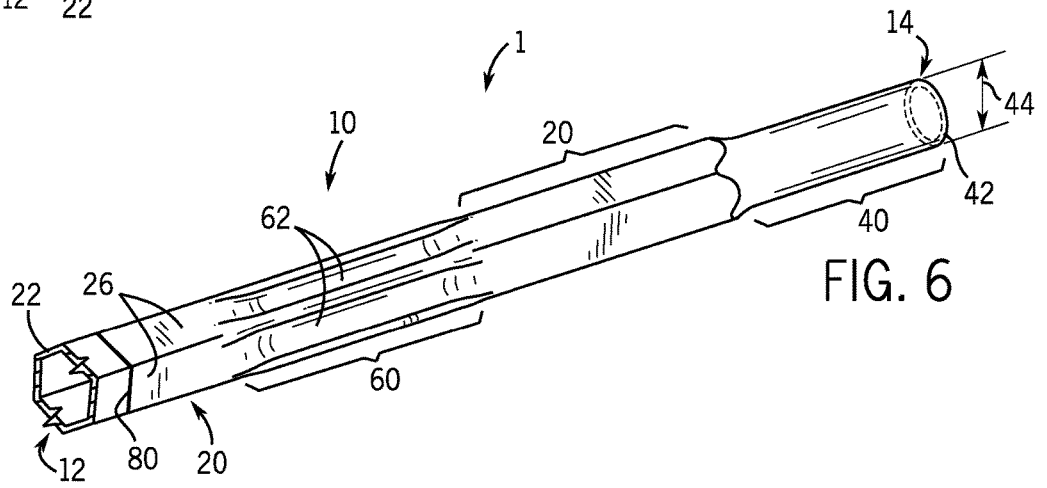

In the embodiments shown in FIGS. 4-6, the second indentations 62 in the second indentation section 60 each extend inwardly towards the axis z from a side 26 of the main cross-section 22 on the body 10. With reference to FIG. 3, it can be seen that the first indentations 52 of the first indentation section 50 are also shown to extend inwardly towards the axis z from the sides 26 of the main cross-section 22.

It should be noted that while the present embodiment shows at least two first indentations 52 and at least two second indentations 62, these indentations may be present in all sides 26 of the main cross-section 22, in one side 26 of the main cross-section 22, or any other number of sides 26. The indentations can also, or additionally, can be made in the edge between adjacent sides 26 in the main cross-section 22, as opposed to each being within a side 26 as shown.

The present inventors have found that having one or more indentations in the pole 1 provides anti-heave protection for the pole 1, particularly where the pole is installed in regions of the world where the ground freezes, as well as anti-wind-lift protection as discussed avovec. Specifically, the first indentations 52 prevent heave or wind lift when the first end 12 of the pole 1 is installed in the ground, and the second indentations 62 prevent heave or wind lift when the second end 14 of the pole 1 is installed in the ground.

It should be known that the presently disclosed pole 1 need not have both a first indentation section 50 and a second indentation 60, depending on the intended use of the first end 12 and the second end 14 of the pole 1, respectively. For example, no second indentation 60 would be necessary in the construction of a one-sided pole 1, saving manufacturing time and expense. Likewise, the first indentation section 50 and/or the second indentation section 60 may be positioned elsewhere on the pole 1, including within the first mount section 30 and/or the second mount section 40, respectively. Similarly, the first indentation section 50 and/or the second indentation section 60 may be positioned closer to the first end 12 and/or the second end 14 than the first mount section 30 and the second mount section 40, respectively.

In other embodiments, one or more of the first indentations 52 and/or the second indentations 62 extend outwardly away from the axis z, which also provide anti-heave and anti-wind-lift protection for the pole 1 as discuss above. Similarly, one or more of the first indentations 52 and/or the second indentations 62 may extend perpendicularly or at other non-parallel angles relative to the axis z.

Beyond the benefit of providing anti-heave (and likewise, anti-lift and anti-twist) protection, indentations, as well as dimples, gussets, and other features, may be incorporated into or along the pole 1 for the purpose of adding strength. In some embodiments, this additional strength is provided where bending moments of the pole 1 are the greatest, including where the pole 1 meets the ground. The present inventors have identified that by providing these features, the pole 1 is better able to withstand or minimize deflection from high wind speeds, loads created by objects supported by the pole 1, and other loading conditions.

Figure 8:
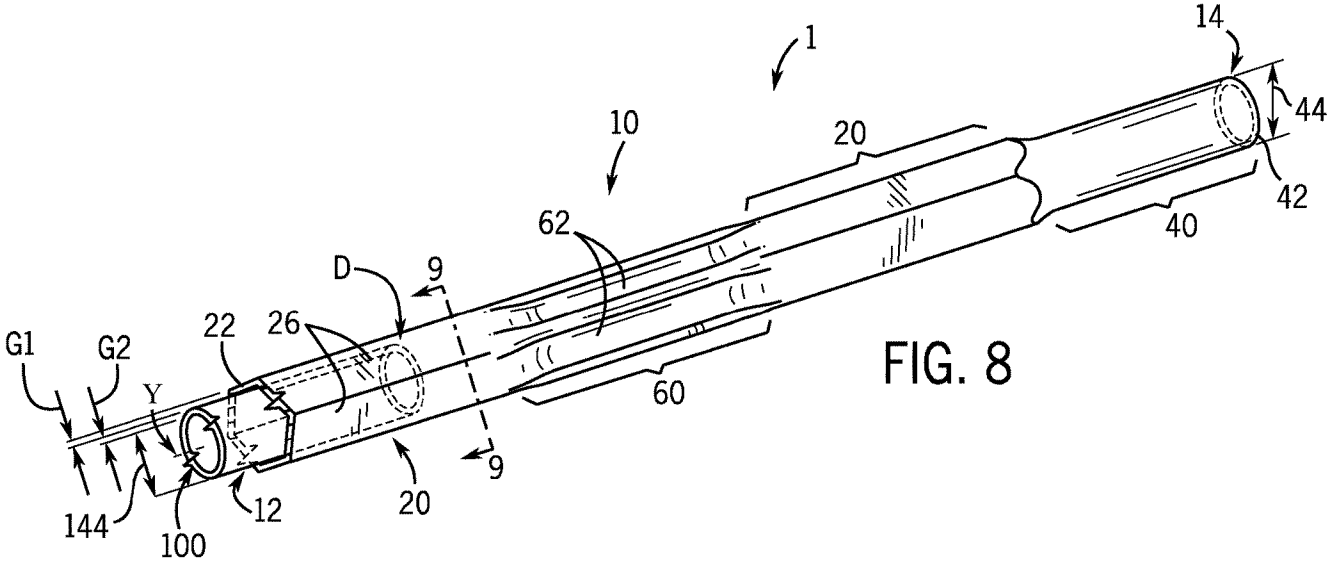
FIG. 8 depicts a partial view of an embodiment similar to the device of FIG. 6 with a secondary pipe nested inside.
Figure 9:
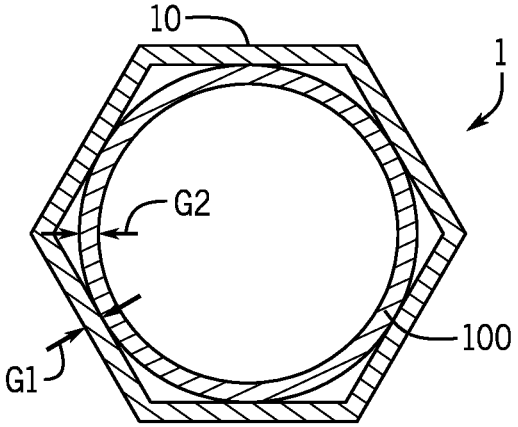
FIG. 9 is a sectional view taken along 9-9 in FIG. 8.

Likewise, in certain embodiments, such as that shown in FIGS. 8-9, a secondary pipe 100 is fitted within the body 10 to provide additional strength. This may be in addition to, or in place of the additional features discussed above, such as gussets. In the embodiment shown, the secondary pipe 100 has a circular cross-section of diameter 144 that is configured to exactly circumscribe the interior of the body 10 when nested therein. In this embodiment, the body 10 is at least partially hollow in order to accept the secondary pipe 100, which may itself be solid or hollow.

It should be recognized that other shapes are also anticipated for both the body 10 and the secondary pipe 100, which may also be the same shape. In the embodiment shown, the body 10 and the secondary pipe 100 are coaxially assign such that respective axes Z and Y are aligned. However, other configurations are also anticipated by the present disclosure, such as a secondary pipe 100 having a "T", "Y", "H", "X"-shaped cross section, for example.

The secondary pipe 100 may remain in place as a press-fit, through engagement of a dimple, rivet, or the like, or through welding or adhesives, for example. As will be recognized by one of ordinary skill in the art, the secondary pipe 100 in many embodiments must be incorporated before the first indentation section 50, secondary indentation section 60, first mount section 30, and/or second mount section 40 are completed in order to ensure clearance.

In the embodiment shown, the secondary pipe 100 overlaps with the body 10 at least in the main section 20 and extends almost to the second indentation section 60, which in certain embodiments also extends to the first indentation section 50 at the other end of the pole 1. However, the present disclosure also anticipates embodiments in which the secondary pipe 100 extends close, or all the way, to the first end 12 and/or the second end 14 of the pole 1. In certain embodiments, the present inventors have identified that the secondary pole 100 is particularly advantageous to incorporate overlapping with the first sight line 70 and/or second sight line 80 (discussed further below), which experience substantial moment arms when forces are applied to the pipe 1 above the ground.

Through experimentation and development, the present inventors have identified that the integration of a secondary pipe 100 not only increases the strength of the pole 1 over otherwise-like poles 1, but also enables manufacturing savings by allowing lighter gauge materials to be used elsewhere. As shown in FIGS. 8-9, the body 10 has a first gauge G1 and the secondary pipe 100 has a second gauge G2. Therefore, the present inventors have identified that, through the incorporation of one or more secondary pipes 100, a lighter first gauge G1 may be used for the body 10 provided that more heavily-loaded regions are reinforced with secondary pipes 100.

Returning to FIG. 3, it can be seen that the pole 1 has a first sight line 70 and a second sight line 80. The first sight line 70 is an indication for how far the pole 1 should be installed into the ground if the first end 12 of the pole 1 is being installed in the ground with the satellite dish 2 being mounted to the second end 14. In other words, the first sight line 70 provides guidance to the installation personnel to the install the first end 12 into the ground until the first sight line 70 is flush with the surface of the ground. Likewise, if the installation requires the satellite dish 2 to be mounted to the first end 12, the second end 14 of the pole 1 is installed into the ground until the second sight line 80 is flush with the surface of the ground. In this manner, the first sight line 70 and second sight line 80 ensure that the installation personnel have installed the pole 1 far enough into the ground to provide the structural integrity necessary to safely support the satellite dish 2. Likewise, the first sight line 70 and the second sight line 80 ensure that the installation personnel have installed the pole 1 sufficiently far in the ground to ensure that the first indentation section 50 or the second indentation section 60, as applicable, are sufficiently deep in the ground to provide the anti-heave and anti-wind-lift protection described above. As discussed above, the present inventors have further added the first sight line 70 and/or second sight line 80 to assist in subsequent photo audits, which clearly demonstrate whether or not the pole 1 was installed at a sufficient depth. In certain embodiments, the specified depth for installation is 36".

FIGS. 4-6 depict three different configurations for the second mount section 40 of the pole 1, which may also be used for the first mount section 30 (though not separately shown). In one embodiment of the pole 1, the first mount section 30 has a first diameter 34 that is different than the second diameter 44, which enables the same pole 1 to be used to support satellite dishes 2 having different mounting requirements.

In order to provide both a main cross-section 22 and a first mount section 30 and second mount section 40 that are configured to function with mounting devices 5 for satellite dishes 2 known in the art, the present inventors developed devices and methods for swedging the main cross-section 22 into circular cross-sections. For example, FIG. 4 shows one embodiment whereby the second mount section 40 is swedged outward from the hexagonal shape of the main section 20 such that the second mount section 40 is a 2⅜ inch round shape. In other words, the second mount section 40 is swedged outwardly such that the second cross-section 42 is circular and the second diameter 44 is 2⅜ inches.

Similarly, FIG. 5 shows a second mount section 40 that is swedged outward such that the second cross-section 42 is circular and the second diameter 44 is 2 inches. In contrast, FIG. 6 shows an embodiment wherein the second mount section 40 has been swedged inwardly from the main cross-section 22 of the main section 20 such that the second cross-section 42 is circular and the second diameter 44 is 1⅔ inches.

It should be known that the pole 1 may be swedged outwardly or inwardly to have different second diameters 44 than those described above, which may be adjusted to adhere to the requirements of the particular satellite dishes 2 and their mounting devices 5. Similarly, a particular embodiment of a pole 1 may be configured such that the first mount section 30 is swedged to have a first diameter 34 that is 2⅜ inches, 2 inches, or 1⅔ inches, while the second mount section 40 is swedged to have a second diameter 44 that is different than the first diameter 34. This enables installation personnel to carry only half the stock of poles 1 to support installation of satellite dishes 2 having differing installation requirements. For example, installation personnel may carry a pole 1 having a first mount section and a second mount section 40 that corresponds to the mounting requirements of the two most popular satellite dishes, or perhaps the two types that they are contracted to install. In cases where more than two mounting requirements exist, the pole 1 of the present disclosure nevertheless enables the stock to be reduced by providing first mount sections 30 and second mount sections 40.

Alternately, the first diameter 34 and second diameter 44 can be the same. Likewise, one of the first mounting section 30 or the second mounting section 40 may have a hexagonal cross-section like the main cross-section 22. While these alternative embodiments may not provide the flexibility to rotate the pole 1 to accommodate the requirements of multiple mounting devices 5, they nonetheless provide the other benefits described above.

It should be known the first mounting section 30 and second mounting section 40 are configurable to comply with the requirements of any mounting device 5, including different shapes and sizes as the case may be.

Figure 7:
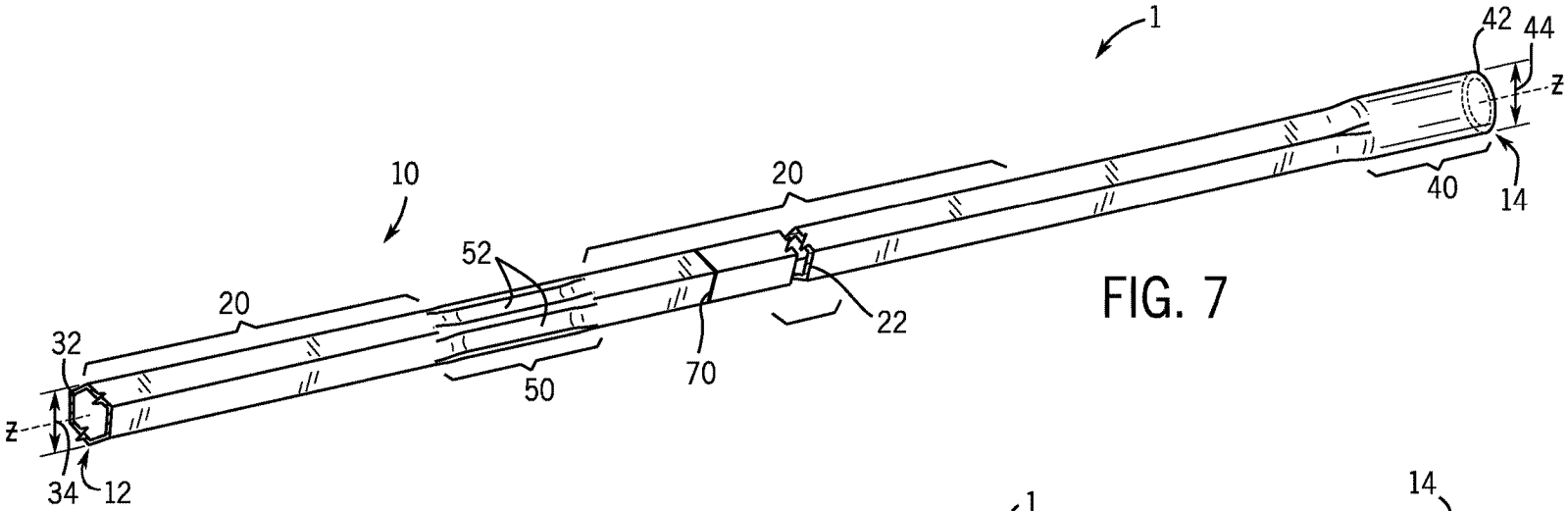
FIG. 7 depicts an embodiment similar to the device of FIG. 3 but configured as a one-sided device.

As discussed above, each of the previously describe features may alternatively be applied to only one side of the pole 1 to produce a one-sided pole 1. FIG. 7 depicts the device of FIG. 3, but without the second indentation section 60, second sight line 80, and first mount section 30. In other words, the one-sided pole 1 of FIG. 7 reduces manufacturing time and expense by providing only one indentation section (first indentation section 50), one sight line (first sight line 70), and one mount section (second mount section 40). Other than the feature of being flipped to support two different sizes of objects, the one-sided pole 1 provides the same strength characteristics, anti-heave and anti-lift, anti-rotation, and installation guidance previously discussed.

In the above description, certain terms have been used for brevity, clarity, and understanding. No unnecessary limitations are to be inferred therefrom beyond the requirement of the prior art because such terms are used for descriptive purposes and are intended to be broadly construed. The different assemblies described herein may be used alone or in combination with other devices. It is to be expected that various equivalents, alternatives and modifications are possible within the scope of any appended claims.

We claim:

1. A device configured to support an object above the ground, the device comprising:

a first end and a second end that is opposite the first end;

an axis defined between the first end and the second end;

a body that surrounds the axis and extends from the first end to the second end;

a mount section of the body that is closer to the first end than to the second end, wherein the mount section has a first cross-section and is configured to be coupled to the object;

a main section of the body located between the mount section and the second end, wherein the main section has a main cross-section, and wherein the main cross-section has a hexagonal shape;

an indentation in the body, wherein the indentation is closer to the second end than to the first end; and a sight line along the main section that is closer to the second end than to the first end, wherein the sight line signifies a distance from the second end to the sight line;

wherein the device is configured to be installed in the ground such that the indentation is below the ground;

wherein the first cross-section has a circular shape; and wherein the indentation is configured to prevent heaving when the device is installed in the ground to a depth whereby the sight line is at or below the ground.

2. A device configured to support an object above the ground, the device comprising:

a first end and a second end that is opposite the first end;

an axis defined between the first end and the second end;

a body that surrounds the axis and extends from the first end to the second end;

a mount section of the body that is closer to the first end than to the second end, wherein the mount section has a first cross-section and is configured to be coupled to the object;

a main section of the body located between the mount section and the second end, wherein the main section has a main cross-section, and wherein the main cross-section has a hexagonal shape;

an indentation in the body, wherein the indentation is closer to the second end than to the first end; and a secondary pipe having a first end and a second end that is opposite the first end, wherein a secondary axis defined between the first end and the second end of the secondary pipe, and wherein the secondary pipe is nested within the body such that the axis of the body and the secondary axis of the secondary pipe are coaxial and such that the secondary pipe prevents deflection of the body;

wherein the device is configured to be installed in the ground such that the indentation is below the ground; and wherein the first cross-section has a circular shape.

3. The device according to claim 2, wherein the second end of the secondary pipe is closer to the second end of the body than to the indentation.

4. The device according to claim 2, wherein the secondary pipe has a circular shape.

5. The device according to claim 2, further comprising a sight line along the main section that is closer to the second end than to the first end, wherein the sight line signifies a distance from the second end to the sight line, wherein the indentation is configured to prevent heaving when the device is installed in the ground to a depth whereby the sight line is at or below the ground.

6. A device configured to support an object above the ground, the device comprising:

a first end and a second end that is opposite the first end;

an axis defined between the first end and the second end;

a body that surrounds the axis and extends from the first end to the second end;

a mount section of the body that is closer to the first end than to the second end, wherein the mount section has a first cross-section and is configured to be coupled to the object;

a main section of the body located between the mount section and the second end, wherein the main section has a main cross-section;

an indentation in the body, wherein the indentation is closer to the second end than to the first end; and a sight line along the main section that is closer to the second end than to the first end, wherein the sight line signifies a distance from the second end to the sight line;

wherein the first cross-section is different than the main cross-section, and wherein the device is configured to be installed in the ground such that the indentation is below the ground, and wherein the indentation is configured to prevent heaving when the device is installed in the ground to a depth whereby the sight line is at or below the ground.

7. The device according to claim 6, wherein the first cross-section has a circular shape and has a first area, wherein the main cross-section has a main area, and wherein the first area is greater than the main area.

8. A device configured to support an object above the ground, the device comprising:

a first end and a second end that is opposite the first end;

an axis defined between the first end and the second end;

a body that surrounds the axis and extends from the first end to the second end;

a mount section of the body that is closer to the first end than to the second end, wherein the mount section has a first cross-section and is configured to be coupled to the object;

a secondary pipe having a first end and a second end that is opposite the first end, wherein a secondary axis defined between the first end and the second end of the secondary pipe, and wherein the secondary pipe is nested within the body such that the axis of the body and the secondary axis of the secondary pipe are coaxial and such that the secondary pipe prevents deflection of the body; and an indentation in the body, wherein the indentation is closer to the second end than to the first end;

wherein the device is configured to be installed in the ground such that the indentation is below the ground.

9. The device according to claim 8, wherein the first cross-section has a circular shape and has a first area, wherein a main section of the body is located between the mount section and the second end, wherein the main section has a main cross-section having a main area, and wherein the first area is greater than the main area.

10. The device according to claim 8, wherein a main section of the body is located between the mount section and the second end, further comprising a sight line along the main section that is closer to the second end than to the first end, wherein the sight line signifies a distance from the second end to the sight line, wherein the indentation is configured to prevent heaving when the device is installed in the ground to a depth whereby the sight line is at or below the ground.

11. The device according to claim 10, wherein the first cross-section has a circular shape and has a first area, wherein the main section has a main cross-section having a main area, and wherein the first area is greater than the main area.

12. A device configured to support an object above the ground, the device comprising:

a first end and a second end that is opposite the first end;

an axis defined between the first end and the second end;

a body that surrounds the axis and extends from the first end to the second end;

a first mount section of the body that is closer to the first end than to the second end, wherein the first mount section has a first cross-section and is configured to be coupled to the object;

a second mount section of the body that is closer to the second end than to the first end, wherein the second mount section has a second cross-section and is configured to be coupled to the object;

a main section of the body located between the first mount section and the second mount section, wherein the main section has a main cross-section, wherein the first cross-section is different than the main cross-section, and wherein the main cross-section and the second cross-section are different;

a first indentation in the body, wherein the first indentation is closer to the first end than to the second end;

a second indentation in the body, wherein the second indentation is closer to the second end than to the first end; and a secondary pipe having a first end and a second end that is opposite the first end, wherein a secondary axis defined between the first end and the second end of the secondary pipe, and wherein the secondary pipe is nested within the body such that the axis of the body and the secondary axis of the secondary pipe are coaxial and such that the secondary pipe prevents deflection of the body;

wherein the device is configured to be installed in the ground such that one of the first indentation or the second indentation is below the ground.

13. The device according to claim 12, wherein the main cross-section has a hexagonal shape, and wherein the first cross-section and the second cross section each have a circular shape.

14. The device according to claim 13, wherein the first cross-section has a first area and the second cross-section has a second area that is different than the first area of the first cross-section.

15. The device according to claim 12, further comprising a sight line along the main section that is closer to the second end than to the first end, wherein the sight line signifies a distance from the sight line to the second end, and wherein the indentation is configured to prevent heaving when the device is installed in the ground to a depth whereby the sight line is at or below the ground.

16. The device according to claim 12, wherein the second end of the secondary pipe is closer to the second end of the body than to the indentation, and wherein the secondary pipe has a circular shape.

* * * * *